US008997385B1

(12) United States Patent
Decastro

(10) Patent No.: US 8,997,385 B1
(45) Date of Patent: Apr. 7, 2015

(54) ROTATABLE FOUNTAIN DISPLAY DEVICE

(71) Applicant: Julio Antonio Decastro, Sunny Isles, FL (US)

(72) Inventor: Julio Antonio Decastro, Sunny Isles, FL (US)

( * ) Notice: Subject to any disclaimer, the term of this patent is extended or adjusted under 35 U.S.C. 154(b) by 0 days.

(21) Appl. No.: 14/311,302

(22) Filed: Jun. 22, 2014

(51) Int. Cl.

| | |
|---|---|
| ***B05B 17/08*** | (2006.01) |
| ***G09F 7/22*** | (2006.01) |
| ***G09F 23/00*** | (2006.01) |
| ***G09F 19/02*** | (2006.01) |

(52) U.S. Cl.
CPC *G09F 7/22* (2013.01); *G09F 23/00* (2013.01); *G09F 19/02* (2013.01); *B05B 17/08* (2013.01)

(58) Field of Classification Search
USPC ..... 40/406, 407, 412, 439, 440; 239/17, 239/214.13, 22, 240, 381, 382, 383; 446/199, 201, 220
See application file for complete search history.

(56) References Cited

U.S. PATENT DOCUMENTS

| | | | | |
|---|---|---|---|---|
| 2,632,191 | A * | 3/1953 | Grafani et al. | 15/22.1 |
| 2,634,545 | A * | 4/1953 | Gertz | 446/199 |
| 3,374,763 | A * | 3/1968 | Browning | 359/525 |
| 4,179,832 | A * | 12/1979 | Lemelson | 40/540 |
| 4,205,785 | A * | 6/1980 | Stanley | 239/17 |
| 4,920,465 | A * | 4/1990 | Sargent | 362/96 |
| 6,375,090 | B1 * | 4/2002 | Beidokhti | 239/17 |
| 6,398,616 | B1 * | 6/2002 | Motosko, III | 446/220 |
| 6,755,349 | B2 * | 6/2004 | Beidokhti | 239/17 |
| 6,848,629 | B2 * | 2/2005 | Palmer et al. | 239/17 |
| 6,892,772 | B1 * | 5/2005 | Wang et al. | 141/313 |
| 7,390,541 | B2 * | 6/2008 | Hsu | 428/9 |
| 2004/0180604 | A1 * | 9/2004 | Chin-Cheng | 446/220 |
| 2006/0006248 | A1 * | 1/2006 | Wu | 239/17 |
| 2006/0150451 | A1 * | 7/2006 | Spielberger et al. | 40/412 |
| 2006/0226257 | A1 * | 10/2006 | Lee | 239/251 |
| 2009/0130948 | A1 * | 5/2009 | Deasy, II | 446/220 |
| 2009/0266908 | A1 * | 10/2009 | Michelsen | 239/17 |
| 2010/0288320 | A1 * | 11/2010 | Rehkemper | 135/96 |
| 2010/0327073 | A1 * | 12/2010 | Kette | 239/8 |
| 2012/0015581 | A1 * | 1/2012 | Feldstein | 446/71 |

* cited by examiner

*Primary Examiner* — Charles A Fox
*Assistant Examiner* — Christopher e Veraa
(74) *Attorney, Agent, or Firm* — Ruben Alcoba, Esq.

(57) ABSTRACT

A rotatable fountain display device rotatably displays an indicia, such as advertisement over a fountain. The device comprises a plurality of spheres immediately adjacent and sequentially connected to each other to rotatably display an indicia, such as an advertisement. The device works in conjunction with a fluid source, such as a fountain, to receive a fluid carrying a fluid pressure. A lower sphere contains a rotation mechanism that harnesses the fluid pressure from the fluid source to generate rotational energy on the lower sphere, which then rotates sequentially connected middle and upper spheres. A central channel runs through the spheres. A nylon elastic member and a rubber band interconnect the spheres and enables multidirectional movement by the spheres. A guide wire passes through the spheres to help counterbalance the movement. An annular bearing apparatus restricts rotation of the central channel and reduces friction during rotation of the rotation mechanism.

20 Claims, 7 Drawing Sheets

ROTATABLE FOUNTAIN DISPLAY DEVICE

BACKGROUND

It is known that a fountain is a piece of architecture which pours water into a basin or jets it into the air to supply drinking water and/or for a decorative or dramatic effect. Often, shopping malls, airports, bus stations, and other public venues have at least one fountain that forms a central meeting point and around which coffee shops, benches, information booths, and children amusement toys are positioned. The shoppers generally spend time in proximity to the fountain.

Typically, shopping malls include one or more buildings forming a complex of shops representing merchandisers, with interconnecting walkways enabling visitors to walk from unit to unit. Some establishments in the shopping mall can include clothes boutiques, furniture galleries, shoe stores, movie theaters, and restaurants. The merchants for these businesses compete with each other for "eyeballs" from the shoppers in the shopping mall.

Often, an advertising poster and billboards can include any printed medium designed to be attached to a wall or vertical surface. Typically advertising posters include both textual and graphic elements, although a poster may be either wholly graphical or wholly text. Advertising posters are designed to be both eye-catching and informative. The merchants at the shopping mall often utilize the advertisement posters to highlight specials and direct shoppers to their store.

In many instances, the posters orient on a wall, glass display, or stand throughout the shopping mall. However, because of the myriad advertisements, stores, and general hustle and bustle around the posters, the message on the advertisement poster can often be overlooked. It may be desirable in public venues to bring to the attention of the public product or service information that pertains to the particular locale. For example, airline or airport restaurant advertising matter would be beneficially displayed at an airport. Likewise, retail shopping advertisements would be desired in a shopping mall.

It is known that advertising space is normally at a premium in airports, bus terminals, shopping malls and the like. Judicious use of available yet unused advertising space benefits the advertiser in conveying a marketing message to the consuming public as well as the consumer who is apprised of perhaps unknown products and services available nearby. A unique platform, such as a fountain, for displaying the poster, billboard, or other medium of advertisement would help attract attention to the desired advertising message.

Decorative water fountains and advertising posters have been used for displaying advertising in public venues in the past, yet none with the present characteristics of the present invention. See Patent numbers: CN 2357396; U.S. Pat. Nos. 1,768,409; and 3,640,463.

For the foregoing reasons, there is a need for a fountain display device comprising a plurality of spheres immediately adjacent and sequentially connected to each other to rotatably display an advertisement.

SUMMARY

The present invention is directed to a fountain display device comprising a plurality of spheres immediately adjacent and sequentially connected to each other to rotatably display an indicia, such as an advertisement. The device works in conjunction with a fluid source, such as a fountain, to receive a fluid carrying a fluid pressure. A lower sphere contains a rotation mechanism that harnesses the fluid pressure from the fluid source to generate rotational energy on the lower sphere, which then rotates sequentially connected middle and upper spheres. A nylon elastic member joined with a rubber band interconnects the spheres. The elastic nature of the nylon elastic member and the rubber band enable lateral and vertical movement is attained during rotation. A guide wire running through the spheres counterbalances this movement by providing a more rigid structure thereto. The counterbalancing effect enables different directional movement for the spheres.

In some embodiments, the device may include at least three interconnected spheres that align inside a generally vertical central channel above the fluid source. The fluid source may include a decorative water fountain that discharges a fluid pressure in a variety of directions, including upwardly and into the device. The central channel extends along a longitudinal axis of the spheres, passing concentrically through each sphere. The central channel is configured to carry the elastic member, the rubber band, and the guide wire, as well as a fluid from the fountain. The guide wire extends from an upper ceiling mount to the fountain beneath. The guide wire helps stabilize the spheres in a generally linear configuration. The nylon elastic member also extends down from the ceiling mount, passing through the spheres to an elastic member junction. From there, the rubber band terminally connects to the lowest sphere at the rubber band. The rubber band member generally terminates at a high point of the fluid from the fountain. The nylon elastic member and the rubber band are efficacious for enabling greater lateral and vertical movement for the spheres. The nylon elastic member and the rubber band also reduce frictional forces and effects of gravity while the spheres rotate.

In some embodiments, the lower sphere positions proximally to the fountain. The lower sphere comprises an interior region where the rotation mechanism is positioned to operatively rotate the entire device. The lower sphere comprises a lower aperture arranged to receive a fluid inlet from the fountain. The lower aperture is configured to enable passage of the fluid from the fountain, and into the central channel for engagement with the rotation mechanism. The fluid pressure acts on the rotation mechanism to rotate the lower sphere and consequently, the middle and upper spheres.

In some embodiments, the rotation mechanism comprises a lower rotating member and an upper rotating member. The lower and upper rotating members align along the central channel. The lower rotating member includes plurality of blades oriented to face the fluid as it emits from the fountain. The lower rotating member extracts energy from the fluid pressure and converts it into rotational energy. The blades attach to a central cone that distributes the rotational energy uniformly. A space forms between the lower rotating member and the upper rotating member. The space serves as an acoustic insulator, helping to reduce noise and vibrations.

The rotational mechanism connects with an inner surface of the lower sphere through a plurality of attachment lines, generally spaced equidistant from each other. In this manner, the rotation mechanism turns the lower sphere, which in turn, rotates the adjacently connected middle and upper spheres. Consequently, the spheres rotate in conjunction around a central axis. The lower sphere thus, controls the rotation of the entire device. A flange attaches to the upper rotational member. As the flange rotates, the upper rotational member rotates at the same velocity. However, the central channel remains stationary and does not rotate. The stationary effect of the central channel is achieved through an annular bearing apparatus that inhibits the central channel from rotating.

The annular bearing apparatus encircles the central channel. A plurality of ball bearings inside the annular bearing apparatus help reduce friction during rotation. An inner stabilizing ring restricts rotational movement and vibrations by the central channel. The plurality of attachment lines also attach the flange to the lower sphere. In this manner, the lower sphere rotates, and the attached spheres rotate in unison with the lower sphere.

In some embodiments, a middle sphere rests adjacently and above the lower sphere. The middle sphere presses against the lower sphere through gravitational forces. As the lower sphere rotates, the middle sphere follows suit. A ring encircles the middle sphere. The ring connects to the middle sphere, such that rotation of the middle sphere causes the ring to rotate accordingly. Additionally, an upper sphere rests adjacently and above the middle sphere. The upper sphere presses against the middle sphere through gravitational forces. In this manner, the spheres rotate in conjunction. The nylon elastic member, the rubber band, and the flexible interconnecting cable between the spheres allows the three spheres to move vertically, laterally, and diagonally relative to each other.

An objective of the present invention is to provide a rotatable advertising display that harnesses fluid pressure from a fountain to create a rotation.

Another objective is to provide a decorative advertisement media that rotates while displaying an advertisement or message.

Another objective is to create flexibility and movement between the spheres, relative to each other. The flexibility enables lateral, vertical, and horizontal movement through a nylon elastic member and a rubber band. A guide wire counterbalances the latitude by forming a more rigid, concentric stabilizing affect.

Another objective is to extract energy from the fluid pressure with the plurality of blades, and convert the energy into rotational energy.

Another objective is to reduce vibrations and friction during rotation with the plurality of ball bearings in the annular bearing apparatus.

Another objective is to restrict rotation of the central channel with the inner stabilizing ring of the annular bearing apparatus.

Another objective is to dampen sound and vibrations from the fluid pressure engaging the lower rotating member with the space between the lower rotating member and the upper rotating member. The space serves as an acoustic insulator.

Another objective is to vary the decorative effect of the device by adding additional spheres and rings, as desired. In any case, the additional spheres rotate in response to the lower sphere.

Yet another objective is to maximize exposure and good will for retailers in a shopping mall by displaying decorative advertisements from a centrally located water fountain.

DRAWINGS

These and other features, aspects, and advantages of the present invention will become better understood with regard to the following description, appended claims, and drawings where:

Figure 5A:
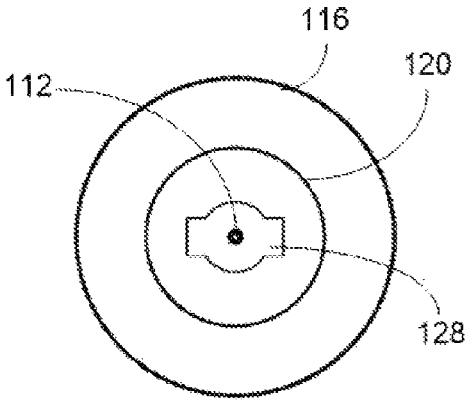
Figure 5B:
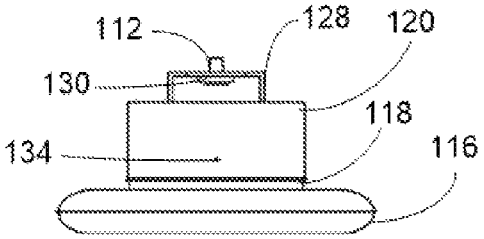
Figure 5C:
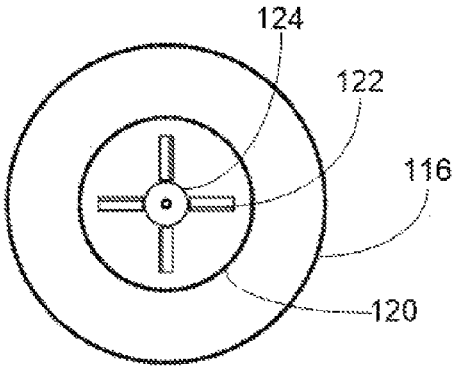
Figure 6B:
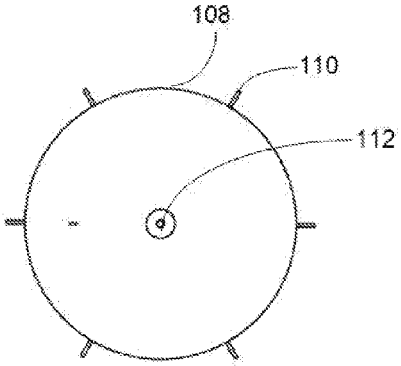
Figure 6A:
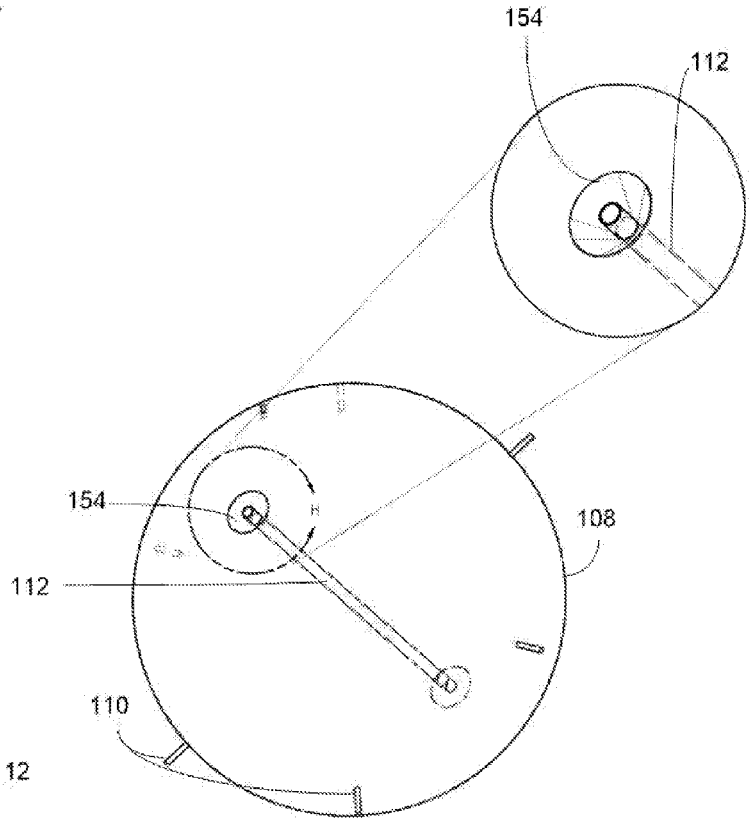
Figure 6C:
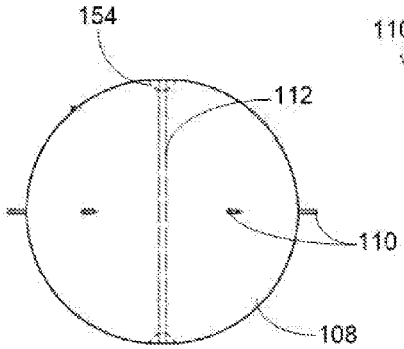
Figure 7A:
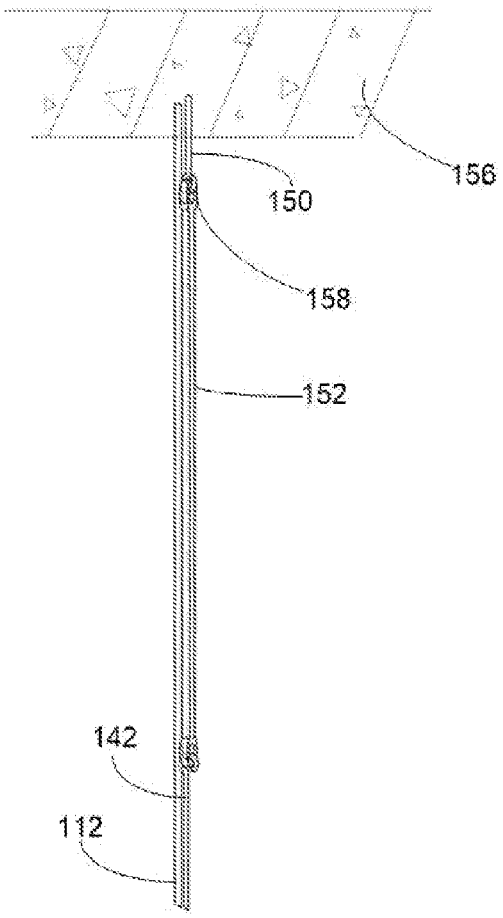
Figure 7B:
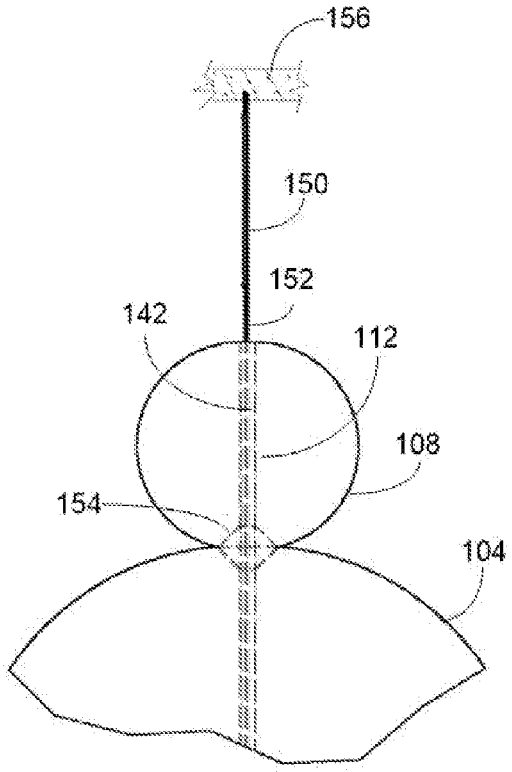

FIGS. 5A, 5B, and 5C are views of the rotation mechanism, where FIG. 5A is a top view, FIG. 5B is an elevated side view, and FIG. 5C is a bottom view showing the blades and central cone;

FIGS. 6A, 6B, and 6C are views of the upper sphere with an exemplary central channel passing through, where FIG. 6A is a blow up view highlighting the upper stabilizing cone, FIG. 6B is a top view, and FIG. 6C is an elevated side view; and FIGS. 7A and 7B are detailed perspective views of an exemplary upper stabilizing cone joined with the upper sphere, and an exemplary guide wire and nylon elastic member attached to an exemplary upper mount.

DESCRIPTION

One embodiment of a rotatable fountain display device 100 is illustrated in FIGS. 1-7B. The fountain display device 100 comprises a plurality of rotating spheres immediately adjacent and sequentially interconnected to each other that rotatably display an indicia, such as an advertisement. However in other embodiments, the indicia may include, without limitation, art, messages, text, images, and digital displays. The device 100 works in conjunction with a fluid source 140 to receive a fluid carrying a fluid pressure 144. The fluid source 140 may include a fountain that generates a fluid pressure 144. However, any piping that carries a fluid may be utilized to generate fluid pressure 144 for the device 100. The device 100 harnesses the fluid pressure 144 from the fluid source 140 to generate rotational energy on a lower sphere 102, which then rotates an adjacently and sequentially connected middle sphere 104 and upper sphere 108. A nylon elastic member 150 and a rubber band 152 that interconnects the spheres 102, 104, 108 allows the spheres 102, 104, 108 to have sufficient flexibility and movement relative to each other, such that an illusion of lateral, vertical, and horizontal movement is created. A guide wire 142 counterbalances the allowed latitude by forming a more rigid, concentric stabilizing affect.

Those skilled in the art will recognize that retailers at a shopping mall receive positive exposure and good will from shoppers by displaying decorative advertisements from a centrally located water fountain. Furthermore, it is known in the art that the rotational speed of each individual sphere 102, 104, 108 depends on the principles of angular momentum, whereby the amount of rotation applied to the spheres 102, 104, 108 is dependent on mass, shape, and speed of each individual sphere 102, 104, 108, along with the amount of pressure contained in the fluid pressure 144.

Figure 1:
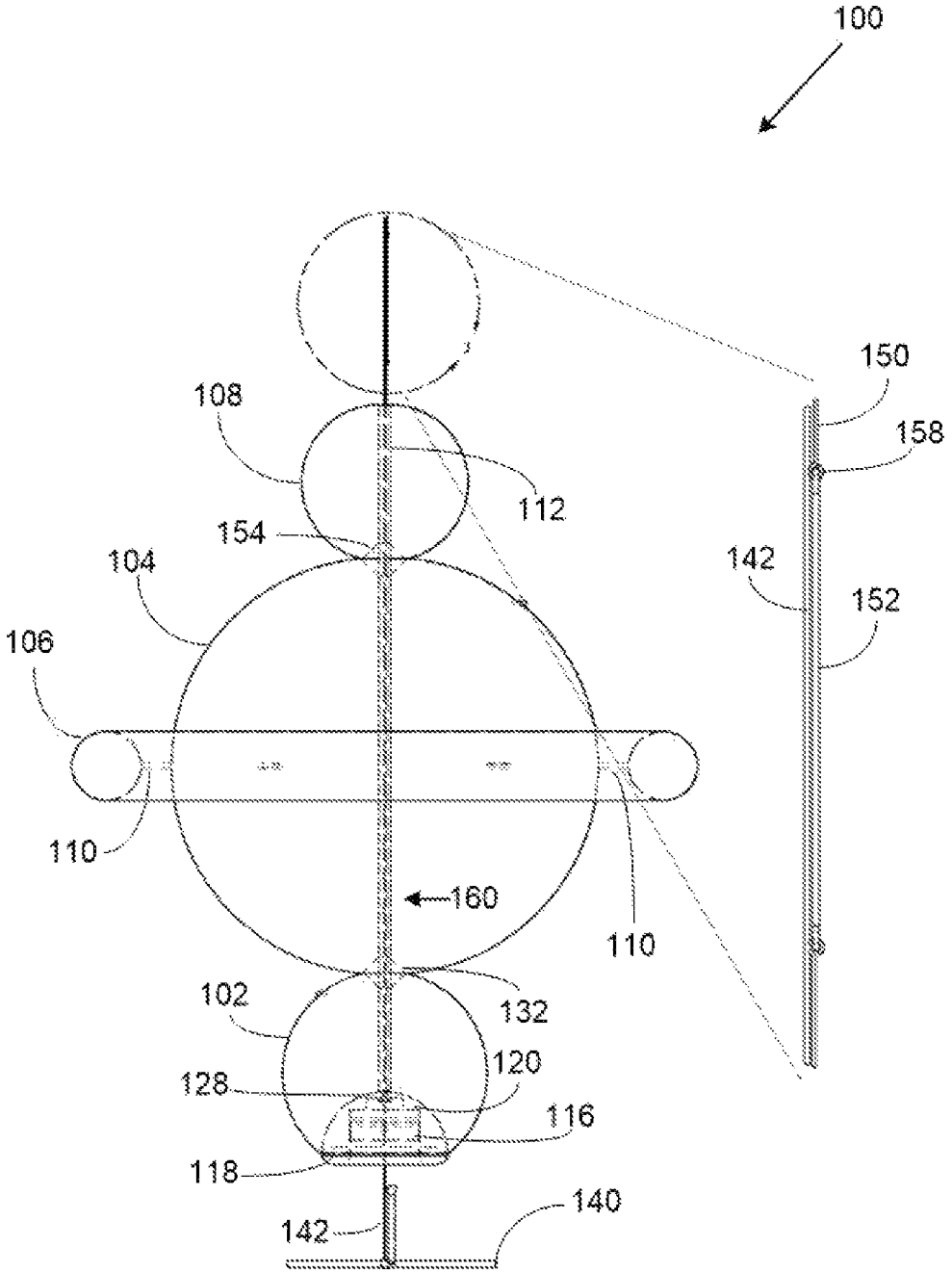
FIG. 1 is a perspective view of the present invention showing an exemplary lower sphere, an exemplary middle sphere, an exemplary ring, and an exemplary upper sphere interconnected.

As referenced in FIG. 1, the device 100 includes at least three interconnected spheres 102, 104, 108. The spheres may be inflated with a gas, with each sphere 102, 104, 108 having a separate gas inlet. Suitable materials for the spheres 102, 104, 108 may include, without limitation, rubber, Hypalon™, and neoprene. In one embodiment, a lower sphere 102, a middle sphere 104, a ring 106, and an upper sphere 108, interconnect through a plurality of interconnection cables 110. The interconnection cables may include a flexible, strong cable made of a nylon, a metal wiring, a polymer, a rubber, or a combination thereof. However in other embodiments the ornamental design of the device 100 may be modified by adding additional spheres and rings as desired. In any case, any additional spheres or rings rotate in response to the lower sphere 102. For example, adding additional spheres of various sizes to the sides of the ring 106 and the upper sphere 108 can create a solar system illusion.

The spheres 102, 104, 108 align concentrically around the central channel 112, and position generally above the fluid source 140. The central channel 112 extends along a longitudinal axis of the device 100, passing concentrically through each sphere 102, 104, 108. The central channel 112 is configured to carry the nylon elastic member 150, the rubber band 152, and the guide wire 142, as well as a fluid from the fluid source 140. The guide wire 142 extends from an upper mount 156 to the fluid source 140. The guide wire 142 helps stabilize the spheres 102, 104, 108 in a generally linear configuration.

The nylon elastic member 150 also extends down from the upper mount 156, passing through the spheres 102, 104, 108, and terminally connecting to the lower sphere 102 at the rubber band 152. The rubber band 152 generally terminates at a high point of the fluid from the fluid source 140. The nylon elastic member 150 and the rubber band 152 are efficacious for enabling greater lateral and vertical movement for the spheres 102, 104, 108. The elastic member 150 and the rubber band 152 also reduce frictional forces and effects of gravity while the spheres 102, 104, 108 rotate. In one embodiment, the nylon elastic member 150 comprises a partial nylon cord. The rubber band 152 is made of rubber. The nylon elastic member 150 and the rubber band 152 join at an elastic member junction 158. The directional movement allowed to the spheres 102, 104, 108 gives great latitude for the device 100 during rotation. Nonetheless, despite the flexibility allowed by the nylon elastic member 150 and the rubber band 152, the guide wire 142 creates a counterbalance by providing a more rigid structure for aligning the spheres 102, 104, 108 to the concentric central channel 112.

Figure 2A:
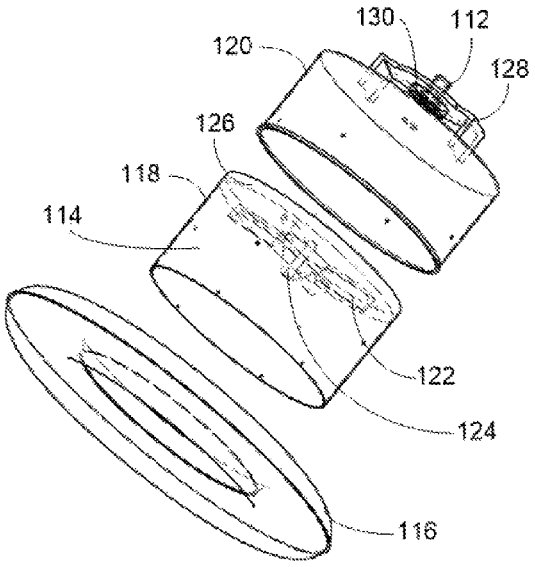
FIGS. 2A and 2B are detailed perspective views of an exemplary rotation mechanism.
Figure 2B:
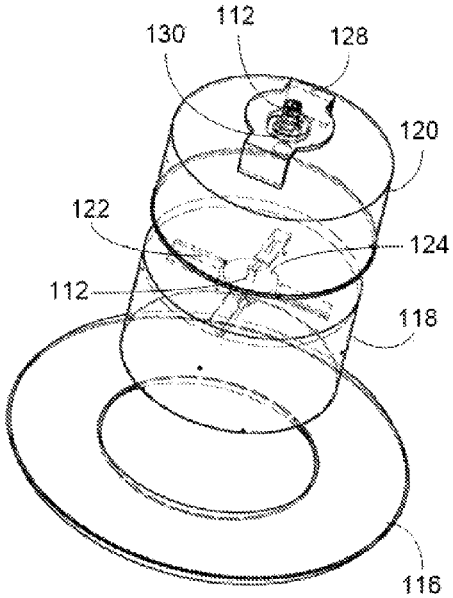

Turning now to FIGS. 2A and 2B, a lower sphere 102 positions proximally to the fluid source. The lower sphere 102 comprises an interior region 114. The interior region 114 comprises a hollow area inside the lower sphere 102. The interior region 114 contains a rotation mechanism 116 that is positioned to receive the fluid pressure 144 through a lower aperture 138. In this manner the rotation mechanism 116 operatively rotates the entire device 100. The lower sphere 102 comprises a lower aperture 138 arranged to receive a fluid inlet from the fluid source 140. The lower aperture 138 is configured to enable passage of the fluid from the fluid source 140, and into the central channel 112 for engagement with the rotation mechanism 116. The fluid pressure 144 acts on the rotation mechanism 116 to rotate the lower sphere 102 and consequently, the middle sphere 104 and the upper sphere 108.

Figure 3:
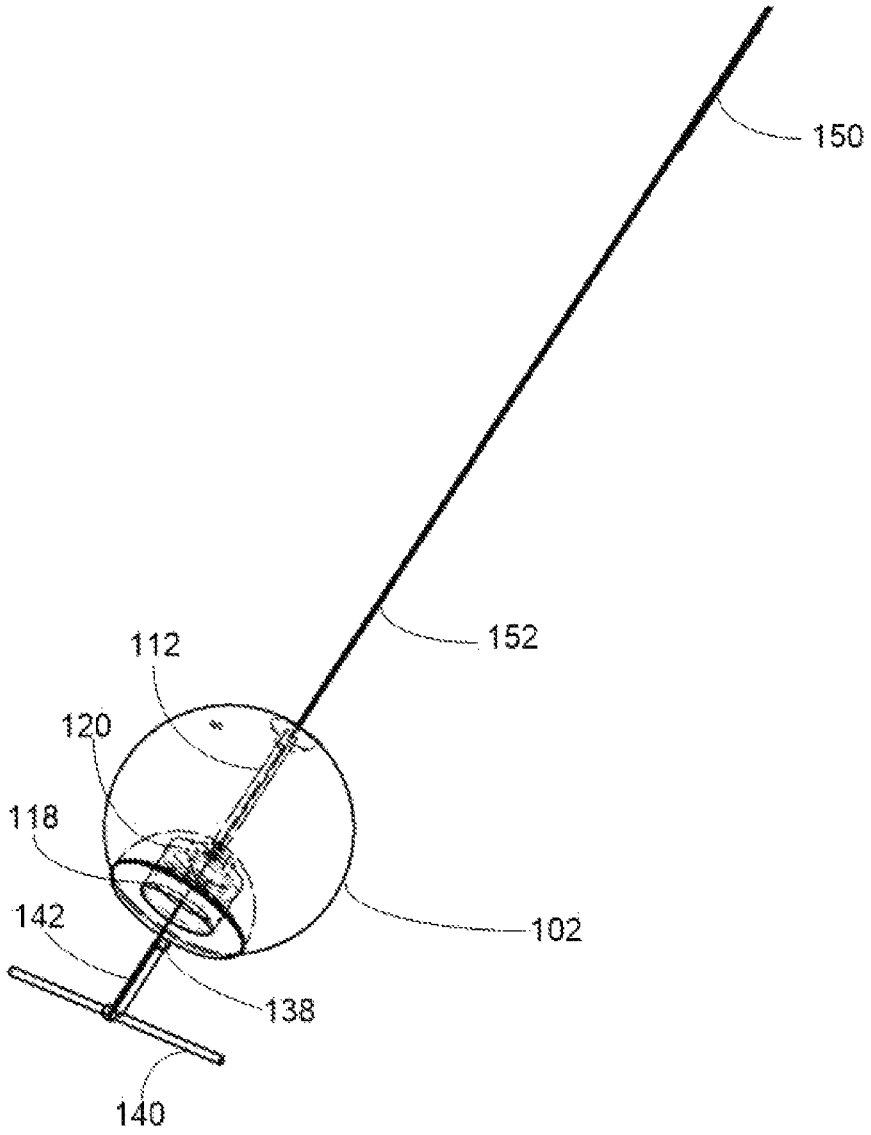
FIG. 3 is a detailed perspective view of an exemplary guide wire passing through the lower sphere and the rotation mechanism.

In reference to FIG. 3, the rotation mechanism 116 comprises a lower rotating member 118 and an upper rotating member 120. The lower and upper rotating members 118, 120 align along the central channel 112 and are separated by a space 126. The lower rotating member 118 includes plurality of blades 122 oriented to face the fluid as it emits from the fluid source 140. The lower rotating member 118 extracts energy from the fluid pressure 144 and converts it into a rotational energy. The blades 122 attach to a central cone 124 that distributes the rotational energy uniformly.

Figure 4:
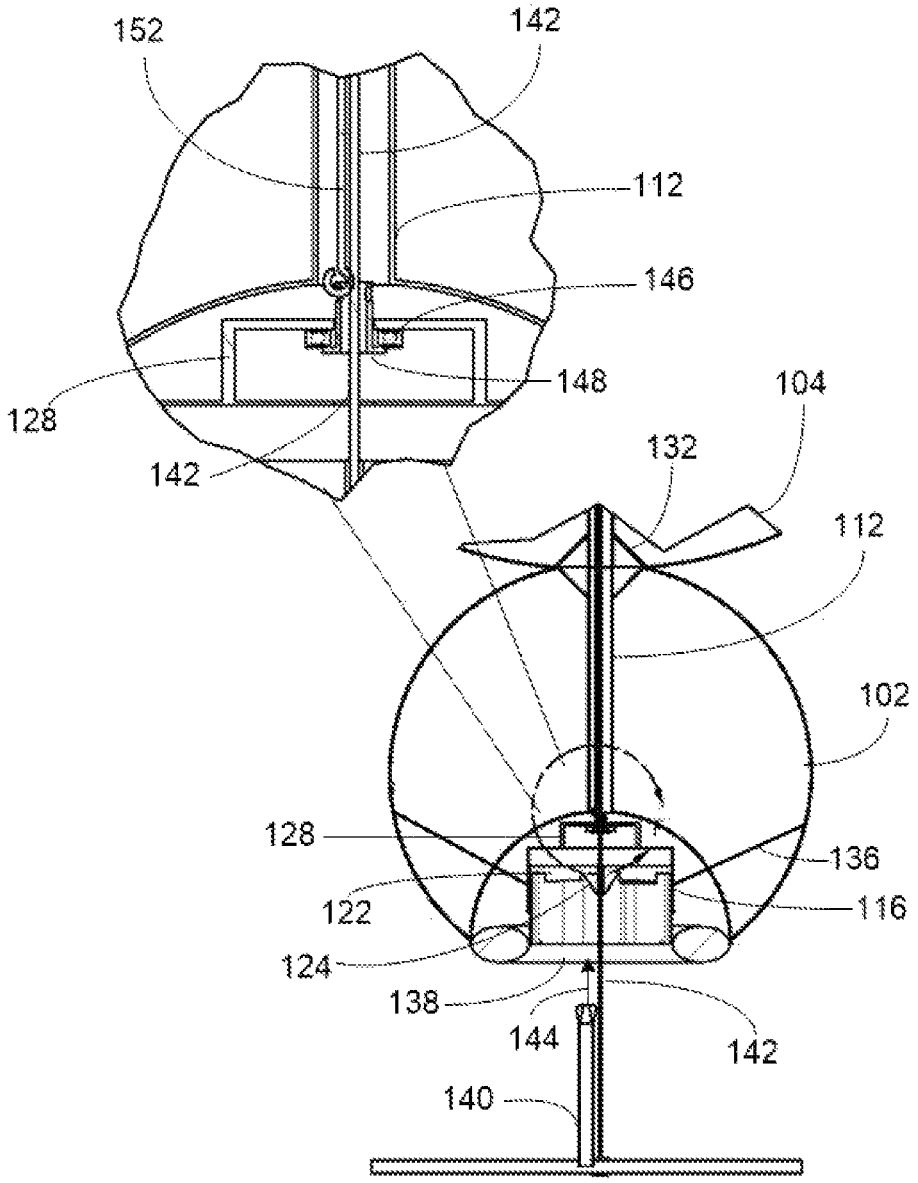
FIG. 4 is a detailed perspective view of an exemplary fluid source providing a fluid through an exemplary lower aperture in the lower sphere.

Turning now to FIG. 4, a space 126 forms between the lower rotating member 118 and the upper rotating member 120. The space 126 serves as an acoustic insulator, helping to reduce noise and vibrations. Those skilled in the art will recognize that the fluid pressure 144 may be significant enough to generate loud noises when engaging the lower rotational member. The space 126 helps reduce the noise.

The rotation mechanism 116 connects with an inner surface of the lower sphere 102 through a plurality of attachment lines 136. The attachment lines 136 may include flexible cables equidistantly spaced. The attachment lines enable the rotation mechanism 116 to control movement of the lower sphere 102, which in turn, rotates the adjacently connected middle sphere 104 and the upper sphere 108. In this manner, the lower sphere 102 dictates the rotation of the device 100.

Turning now to FIGS. 5A, 5B and 5C, a flange 128 attaches to the upper rotating member 120 through a fastener that passes through at least one flange aperture. As the flange 128 rotates, the upper rotating member 120 rotates at the same angular velocity. However, the central channel 112 remains stationary and does not rotate. The stationary effect of the central channel 112 is achieved through an annular bearing apparatus 130 that inhibits the central channel 112 from rotating. This is because the plurality of blades 122 and the central cone 124 operate independently of the central channel 112, as depicted in FIG. 6.

Turning back to FIG. 4, an annular bearing apparatus 130 encircles the central channel 112. The annular bearing apparatus 130 reduces frictional forces through the use of bearings. In one example, a plurality of ball bearings 146 inside the annular bearing apparatus 130 help reduce friction during rotation. However, any type of bearing may be utilized in other embodiments. An inner stabilizing ring 148 restricts rotational movement by the central channel 112. The plurality of attachment lines 136 also attach the flange 128 to the lower sphere 102. In this manner, the lower sphere 102 rotates, and the middle and upper spheres 104, 108 rotate accordingly.

In some embodiments, a middle sphere 104 rests adjacently and above the lower sphere 102. The middle sphere 104 presses against the lower sphere 102 through gravitational forces. As the lower sphere 102 rotates, the middle sphere 104 follows suit. A ring 106 encircles the middle sphere 104. The ring 106 connects to the middle sphere 104, such that rotation of the middle sphere 104 causes the ring 106 to rotate accordingly.

As referenced in FIGS. 6A, 6B, and 6C, an upper sphere 108 rests adjacently and above the middle sphere 104. The upper sphere 108 presses against the middle sphere 104 through gravitational forces. In this manner, the spheres 102, 104, 108 rotate in conjunction around a central axis 160 of the spheres 102, 104, 108. Furthermore, the nylon elastic member 150, the rubber band 152, and the plurality of interconnecting cables 110 also provides sufficient freedom to allows the spheres 102, 104, 108 to move in conjunction around the central axis 160. FIGS. 7A and 7B illustrate how the nylon elastic member 150 joins with the upper mount 156. The upper mount 156 may include a ceiling, a support bar, and a wall.

In one aspect of the present invention, a display device 100 rotatably displays an indicia through fluid pressure converted into rotational energy, the display device 100 comprising:

- a lower sphere 102 configured to rotate in response to a fluid pressure 144, the lower sphere comprising an interior region 114,
- the interior region 114 comprising a rotation mechanism 116 configured to harness the fluid pressure 144 for rotating the lower sphere 102,
- the rotation mechanism 116 comprising a lower rotating member 118, the lower rotating member 118 comprising a plurality of blades 122 configured to convert the fluid pressure 144 into a rotational energy, the rotation mechanism 116 further comprising a cone 124 configured to uniformly distribute the rotational energy to the lower sphere 102, the rotation mechanism 116 further comprising an upper rotating member 120, the rotation mechanism 116 further comprising a space 126 arranged between the lower rotating member 118 and the upper rotating member 120, the space 126 configured to at least partially dampen sound and vibrations generated by the fluid pressure 144 engaging the lower rotating member 118;

a middle sphere 104 disposed immediately adjacent and sequentially connected to the lower sphere 102, the middle sphere 104 configured to press against and rotate the lower sphere 102;

a ring 106 configured to encircle and attach to the middle sphere 104;

an upper sphere 108 disposed immediately adjacent and sequentially connected to the middle sphere 104, the upper sphere 108 configured to press against and rotate the middle sphere 104;

a central channel 112 arranged to pass through the lower sphere 102, and the middle sphere 104, and the upper sphere 108, the central channel 112 configured to carry a guide wire 142, the guide wire 142 disposed to extend from a mounting surface to the fluid source 140, the guide wire 142 configured to stabilize the lower sphere 102, and the middle sphere 104, and the upper sphere 108, the central channel 112 further configured to carry a nylon elastic member 150 and a rubber band 152, the nylon elastic member 150 and the rubber band 152 configured to extend form the mounting surface to the lower sphere 102, the nylon elastic member 150 configured to enable lateral and vertical movement by the lower sphere 102, the middle sphere 104, and the upper sphere 108; and an annular bearing apparatus 130 disposed to encircle the central channel 112, the annular bearing apparatus 130 configured to restrict vibrations from the rotational energy, the annular bearing apparatus 130 further configured to restrict rotation of the central channel 112.

In a second aspect, the fluid source 140 comprises a fountain.

In another aspect, the indicia comprises an advertisement.

In another aspect, the middle sphere 104 is generally larger than the lower sphere 102 and the upper sphere 108.

In another aspect, the lower sphere 102, and the middle sphere 104, and the upper sphere 108 are inflatable through separate air sources.

In another aspect, the lower sphere 102, and the middle sphere 104, and the upper sphere 108, and the ring 106 interconnect through a plurality of interconnection cables 110.

In another aspect, the flange 128 attaches to the upper rotating member 120 through a pair of fasteners that pass through at least one flange aperture.

In another aspect, the rotation mechanism 116 attaches to an inner surface of the lower sphere 102 through a plurality of attachment lines 136.

In another aspect, the plurality of attachment lines 136 fasten to the rotation mechanism 116 at a plurality of eyelets 134.

In another aspect, the guide wire 142 comprises a metal cable.

In another aspect, the nylon elastic member 150 comprises a nylon material, and the connected rubber band comprises a rubber material.

In another aspect, an upper stabilizing cone 154 positions on the upper sphere 108, the upper stabilizing cone 154 configured to increase a surface contact area between the central channel 112 and the upper sphere 108 for enhanced stability.

In another aspect, a lower stabilizing cone 132 positions on the lower sphere 102, the lower stabilizing cone 132 configured to increase a surface contact area between the central channel 112 and the lower sphere 102 for enhanced stability.

In another aspect, the fluid emits from the fluid source 140 to a maximum height approximately between the lower sphere 102 and the middle sphere 104.

In another aspect, the rubber band 152 extends down to the maximum height of the fluid.

In another aspect, the lower rotating member 118 and the upper rotating member 120 comprise a substantially cylindrical shape.

In another aspect, the annular bearing apparatus 130 comprises a plurality of ball bearings 146 configured to reduce friction during rotation of the device 100.

In another aspect, the annular bearing apparatus 130 comprises an inner stabilizer ring 148 configured to restrict rotation of the central channel 112.

While the inventor's above description contains many specificities, these should not be construed as limitations on the scope, but rather as an exemplification of several preferred embodiments thereof. Many other variations are possible. For example, the number and size of the spheres 102, 104, 108 could be varied, and in one example, configured to display a planetary solar system. Accordingly, the scope should be determined not by the embodiments illustrated, but by the appended claims and their legal equivalents.

What is claimed is:

1. A display device for rotatably displaying an indicia, the display device comprises:

a lower sphere comprising an interior region, the interior region comprising a rotation mechanism configured to harness a fluid pressure for rotating the lower sphere, the rotation mechanism comprising a lower rotating member, the lower rotating member comprising a plurality of blades for converting the fluid pressure into a rotational energy, the rotation mechanism further comprising a cone, the rotation mechanism further comprising an upper rotating member, the rotation mechanism further comprising a space arranged between the lower rotating member and the upper rotating member;

a middle sphere immediately adjacent and sequentially connected to the lower sphere;

a ring, attaching to the middle sphere;

an upper sphere immediately adjacent and sequentially connected to the middle sphere;

a central channel, passing through the lower sphere, and the middle sphere, and the upper sphere, the central channel for carrying a guide wire, the guide wire extending from a mounting surface to a fluid source, wherein the guide wire at least partially stabilizes the lower sphere, and the middle sphere, and the upper sphere, the central channel carrying a nylon elastic member and a rubber band, the nylon elastic member extending from the mounting surface to an elastic member junction, the rubber band extending from the elastic member junction to the lower sphere; and an annular bearing apparatus encircling the central channel.

2. The device of claim 1, in which the fluid source comprises a fountain.

3. The device of claim 2, in which the indicia comprises an advertisement that is displayed on either the lower, middle, or upper sphere.

4. The device of claim 3, in which the middle sphere is generally larger than the lower sphere and the upper sphere.

5. The device of claim 4, in which the lower sphere, and the middle sphere, and the upper sphere are inflatable through separate air sources.

6. The device of claim 5, in which the lower sphere, and the middle sphere, and the upper sphere comprise an inflatable rubber material.

7. The device of claim 6, in which the lower sphere, and the middle sphere, and the upper sphere, and the ring interconnect through a plurality of interconnection cables, the lower sphere, and the middle sphere, and the upper sphere, and the ring rotate around a central axis.

8. The device of claim 7, in which the lower sphere comprises a lower aperture for receiving a fluid from the fluid source.

9. The device of claim 8, in which the central channel passes through a flange.

10. The device of claim 9, in which the flange attaches to the upper rotating member through a pair of fasteners that pass through at least one flange aperture.

11. The device of claim 10, in which the rotation mechanism attaches to an inner surface of the lower sphere through a plurality of attachment lines.

12. The device of claim 11, in which the plurality of attachment lines fasten to the rotation mechanism at a plurality of eyelets.

13. The device of claim 12, in which the guide wire comprises a metal cable.

14. The device of claim 13, in which the nylon elastic member is fabricated from a nylon material, the rubber band is fabricated from a rubber material.

15. The device of claim 14, in which an upper stabilizing cone positions on the upper sphere, the upper stabilizing cone configured to increase a surface contact area between the central channel and the upper sphere for enhanced stability.

16. The device of claim 15, in which a lower stabilizing cone positions on the lower sphere, the lower stabilizing cone configured to increase a surface contact area between the central channel and the lower sphere for enhanced stability.

17. The device of claim 16, in which the fluid emits from the fountain to a maximum height approximately between the lower sphere and the middle sphere.

18. The device of claim 17, in which the rubber band extends down to the top of the rotation device.

19. The device of claim 18, in which the lower rotating member and the upper rotating member comprise a substantially cylindrical shape.

20. The device of claim 19, in which the annular bearing apparatus comprises a plurality of ball bearings configured to reduce friction during rotation of the device, the annular bearing apparatus further comprising an inner stabilizer ring configured to help restrict rotation of the central channel.

* * * * *